United States Patent [19]

Gardner

[11] Patent Number: 4,540,847

[45] Date of Patent: Sep. 10, 1985

[54] ELECTRIFIED CEILING SYSTEM

[75] Inventor: Arthur W. Gardner, Markham, Canada

[73] Assignee: CDA Industries, Inc., Scarborough, Canada

[21] Appl. No.: 333,533

[22] Filed: Dec. 22, 1981

Related U.S. Application Data

[63] Continuation of Ser. No. 124,918, Feb. 26, 1980, abandoned, which is a continuation of Ser. No. 910,631, May 30, 1978, abandoned.

[30] Foreign Application Priority Data

May 31, 1977 [CA] Canada ..... 279569

[51] Int. Cl.[3] ..... H02G 3/28

[52] U.S. Cl. ..... 174/48; 52/484

[58] Field of Search ..... 174/48, 49; 52/28, 29, 52/220, 221, 484, 781

[56] References Cited

U.S. PATENT DOCUMENTS

| | | | |
|---|---|---|---|
| 2,888,113 | 5/1959 | Schwartz et al. | 174/49 X |
| 3,001,001 | 9/1961 | Bibb | 174/48 X |
| 3,146,956 | 9/1964 | Schwartz et al. | 174/49 X |
| 3,277,624 | 10/1966 | Cornell | 52/484 |
| 3,345,022 | 10/1967 | Jorgenson | 174/48 X |
| 3,596,425 | 8/1971 | Kodaras | 52/781 X |
| 3,649,741 | 3/1972 | Fremont | 174/48 |
| 3,683,101 | 8/1972 | Liberman | 174/49 |
| 3,685,238 | 8/1972 | Fisher | 52/781 X |
| 3,725,568 | 4/1973 | Stanley | 174/48 |
| 4,047,348 | 9/1977 | McSweeney | 52/484 |

*Primary Examiner*—A. T. Grimley
*Assistant Examiner*—D. A. Tone
*Attorney, Agent, or Firm*—George A. Rolston

[57] ABSTRACT

A ceiling structure which comprises a plurality of mutually parallel, mutually spaced apart, hollow, metallic and longitudinal members formed of a plurality of longitudinal segments in end to end relation, a plurality of metallic transverse members having inwardly facing surfaces, and terminally secured to the longitudinal members and extending therebetween to form a grid-like structure including open spaces and having electrical continuity throughout its longitudinal members, and being adapted to receive insulated electrical cables disposed within at least some of the longitudinal members, junction plates fastened on opposite sides of the longitudinal segments at their ends, joining same together in end to end relation, attachment flanges on the junction plates, a pair of connector ribs, fastened on opposite inwardly facing, surfaces of the transverse members at their ends, and dimensioned to fit around respective attachment flanges and interlockable therewith in self-supporting relation, locking clip means on the attachment flanges, clip receiving recesses in the connector ribs, support on the grid-like structure for supporting ceiling panels generally between the longitudinal members and within the open spaces, and, suspension on the grid-like structure whereby the same may be suspended in position.

25 Claims, 5 Drawing Figures

ELECTRIFIED CEILING SYSTEM

This is a continuation of application Ser. No. 124,918, filed Feb. 26, 1980, now abandoned, which in turn is a continuation of application Ser. No. 910,631, filed May 30, 1978, now abandoned.

BACKGROUND OF THE INVENTION

The present invention relates generally to ceiling structures and more particularly to a ceiling structure of the type which comprises a grid of supporting strut members for supporting lighting fixtures, air handling outlets, ceiling panels and the like.

The arrangement of electrical wiring conduits in office and light industrial buildings varies considerably. For example, such ducts are sometimes laid in the flooring or in the air space between the ceiling and the next upwardly adjacent floor.

In order to achieve maximum flexibility in the use and partition of such office, light industrial and commercial space, it is desirable that the wiring be capable of being arranged across the space in parallel lines with provision for tapping into the electrical conduits at various points as may be required from time to time.

Various systems have heretofore been proposed for satisfying these objectives.

However, such known systems have suffered from a variety of defects, being either unduly complex or expensive or, in some cases, failing to provide the facility with maximum electrical wiring distribution in the most efficient and economical way.

The erection of a suspended ceiling in such commercial, office or industrial space often employs a rectangular grid of supporting struts suspended from the floor above. Ceiling panels, lighting fixtures and air handling facilities are also incorporated in or supported on such a grid. In some cases, electrical services, conduits and the like have been located in the space between such a ceiling grid, and the floor above. Electrical services are then led through the ceiling to the working area below by vertical posts or columns.

This known system permits a highly flexible and convenient electrical distribution system but results in a complex network of wires, conduits, air ducts and the like, occupying the limited space between the ceiling and the floor above.

In addition installation and servicing of facilities in such a limited space involves various trades which may sometimes cause difficulty.

SUMMARY OF THE INVENTION

The present invention seeks to combine the function of a ceiling strut grid with that of electrical distribution in a single ceiling structure.

Broadly a ceiling structure in accordance with this invention comprises a plurality of mutually parallel, mutually spaced apart, hollow, metallic and longitudinal members; a plurality of metallic transverse members terminally secured and electrically connected to said longitudinal members and extending therebetween to form a grid-like structure including open spaces and having electrical continuity throughout its construction; insulated electrical cables disposed within at least some of said longitudinal members; and supporting means on said grid-like structure for supporting ceiling panels generally between said longitudinal members and within said open spaces.

In accordance with a preferred feature of this invention, a ceiling structure in accordance therewith is provided with a plurality of electrical receptacle fittings and fastener means for fastening such receptacles in position on the longitudinal members at spaced intervals therealong.

In accordance with another feature of this invention, a ceiling structure in accordance therewith may be combined with vertically extending electrical supply posts extending downwardly to the floor from the ceiling and provided with electrical outlets so to provide for electrical distribution in the working space beneath the ceiling.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration in the accompanying drawings in which.

DESCRIPTION OF THE PREFERRED EMBODIMENT

Figure 1:
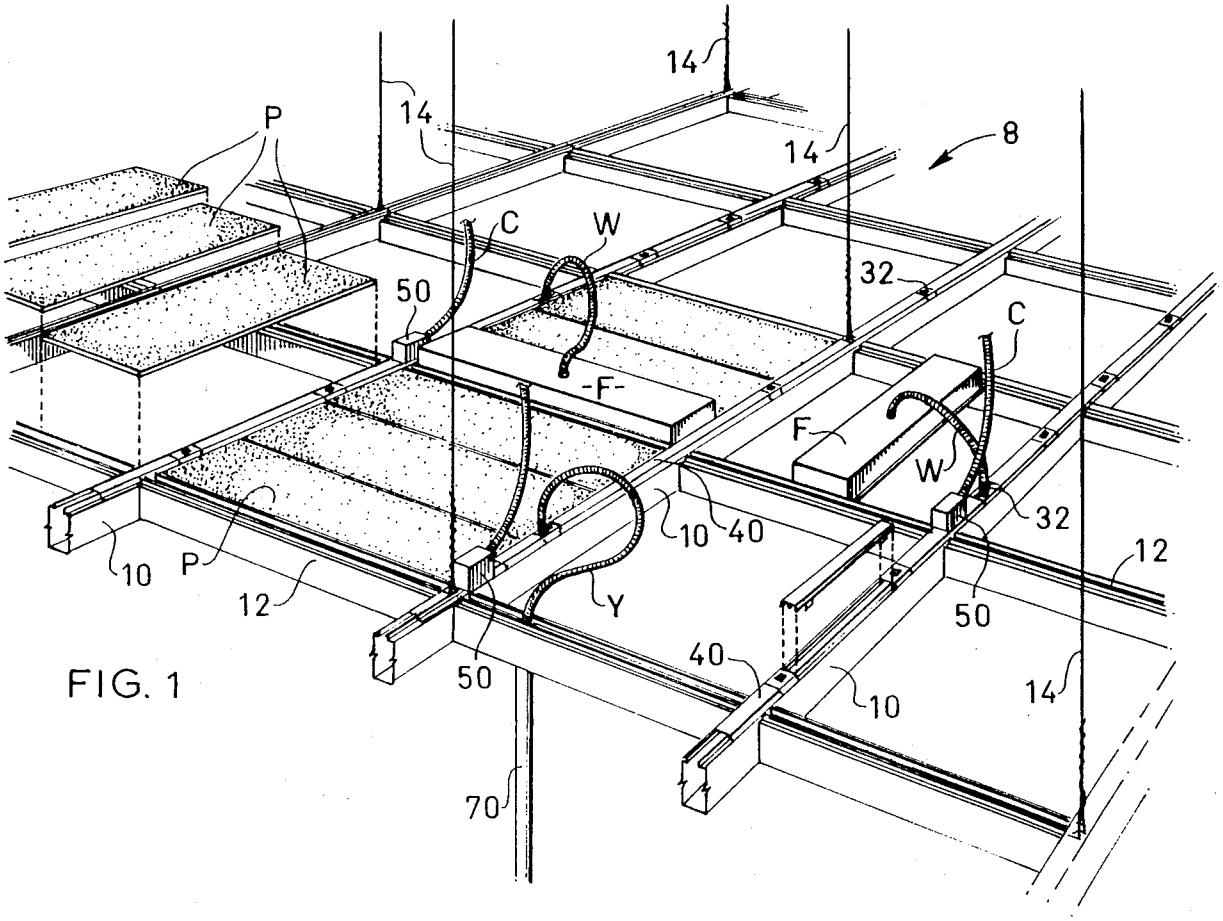
FIG. 1 is a fragmentary and somewhat schematic perspective view from above of one embodiment of a ceiling structure according to the invention, and showing various optional features provided pursuant to preferred features of this invention.

Referring first to FIG. 1, it will be seen that the invention is illustrated therein as comprising a rectangular grid-like structure generally indicated at 8 for supporting a ceiling. Known rectangular grid type ceilings have in the past usually comprised simple T-shaped strut members for supporting ceiling panels, accoustic panels, lighting fixtures, air handling fixtures and the like.

In the present invention, similar ceiling panels or accoustic panels illustrated as P are shown for closing off the openings in the grid-like structure. In addition, two lighting fixtures indicated at F in the form of fluorescent lighting troffers are also shown.

While specific air handling fixtures such as inlets, outlets, duct work and the like are not shown, it will of course be appreciated and well understood by those in the art that such fixtures can readily be placed in position, as desired, in the ceiling structure 8 in generally the same way as in known forms of rectangular grid type ceilings.

The ceiling structure 8 comprises mutually spaced apart longitudinal members or struts 10 and mutually spaced apart transverse members or struts 12 terminally secured to the longitudinal struts 10 to form a grid-like structure including the aforementioned openings. The ceiling structure 8 is supported from an overhead structure at suitably spaced intervals by means such as the support wires indicated at 14.

In accordance with well known practice, the support wires 14 are attached to any suitable portions of the building fabric typically to the underside of the floor above (not shown).

Figure 2:
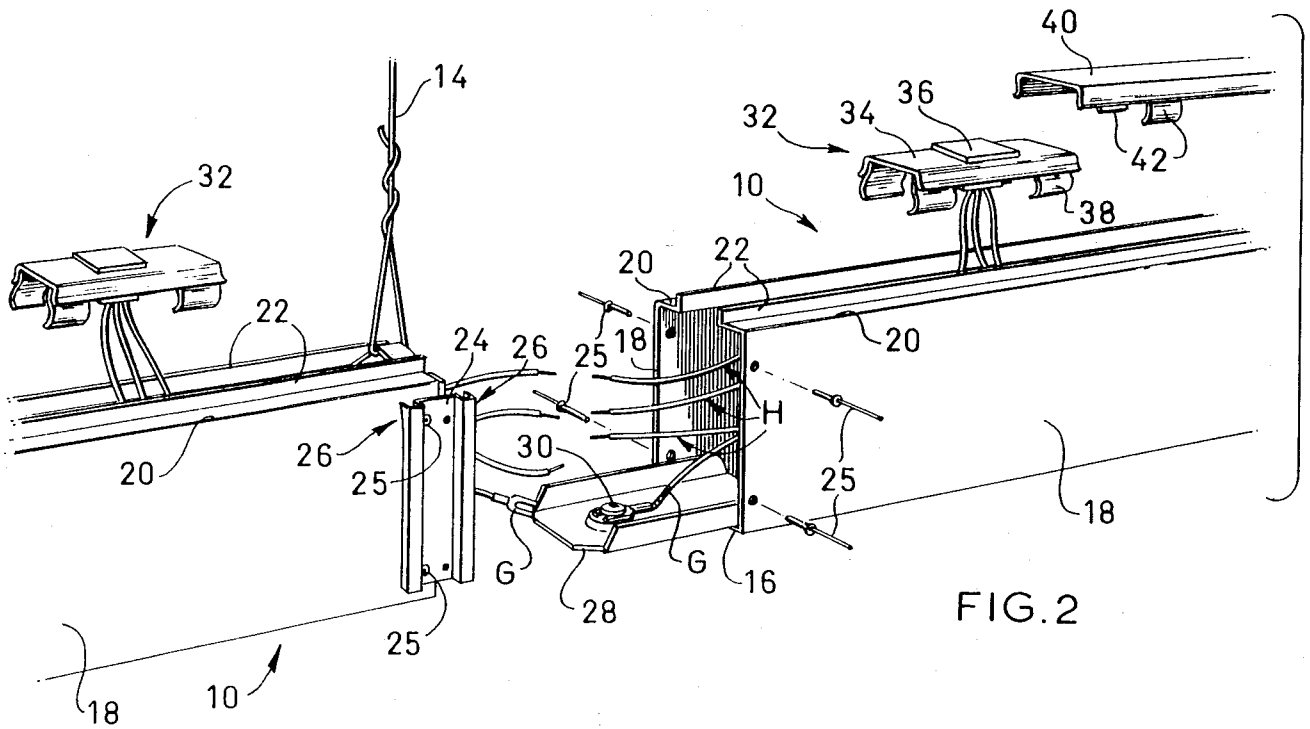
FIG. 2 is an exploded and fragmentary perspective view of two longitudinal members forming part of the ceiling structure shown in FIG. 1.

Referring now in more detail to FIG. 2, it will be seen that two of the longitudinal struts 10 are shown therein in exploded or spaced apart relationship.

Each of such struts 10 will be seen to comprise a generally hollow tubular section of sheet metal having a flat bottom wall 16 (FIG. 3), vertical and flat side walls 18, and two partial horizontal top wall portions 20.

Spaced apart and upwardly extending flanges or lips 22 are formed along the free or inner edges of the top wall portions 20.

Mechanical connection of the ends of adjacent lengths of the struts 10 is achieved by means of sheet metal junction plate members 24 which are fastened to the struts 10 by any suitable means such as sheet metal screws or rivets 25 as shown. It is to be noted that the junction plate members 24 are omitted from FIGS. 1 and 4.

The junction plates 24 are formed along their side edges with flanges 26 for attachment of the transverse struts 12 in the manner yet to be described. It is to be noted that the free edges of the flanges 26 are positioned outwardly of the side walls 18.

Electrical ground continuity between adjacent ones of the longitudinal struts 10 is provided by means of tongue members 28 which are spot welded to one end of each such longitudinal strut 10 so as to extend longitudinally therefrom. Each such tongue member 28 has a width which is less than the interior width of the strut 10 so that it will fit between the side walls 18 of an adjacent strut 10 as will be readily understood from FIG. 2.

The tongue members 28 are provided with suitable electrical fastening means such as a bolt 30 to which ground wires G are attached for a reason yet to be explained.

Suitable electrical plug-receiving receptacles generally indicated at 32 are also usefully provided. Each such receptacle 32 comprises a face plate 34, an electrical plug-receiving portion 36 mounted in the face plate 34 and a plurality, in this case, four spring steel leg portions 38.

The legs 38 are dimensioned so as to make a snap-fit between the upstanding lips 22 of the top wall portions 20 and to ground the cover plates 34 to the struts 10. The ground terminals of the plug-receiving portions 36 are connected by the ground wires G to a respective one of the bolts 30.

In accordance with the invention, the longitudinal struts 10 are provided with a suitable decorative exterior coating such as paint or the like on their outwardly directed surfaces but their inwardly directed surfaces, at least along the opposed faces of the lips 22, are left free of any coating which would inhibit good electrical contact between such lips 22 for example and the aforementioned legs 38.

Wiring harnesses H (FIG. 2) are laid within at least some of the longitudinal struts 10 to supply electrical power to the receptacles 32. To facilitate the introduction of such harnesses H the longitudinal struts 10 are provided with removable cover plates 40 which are provided in turn, with a plurality of spring legs 42 depending downwardly therefrom at suitably spaced intervals therealong for holding them in position on the longitudinal struts 10.

The cover plate members 40 may be made in different lengths and may, for example, be made with weakened portions at predetermined spaced points therealong so that they may be readily broken off to desired lengths to fit any particular modular arrangement.

Figure 3:
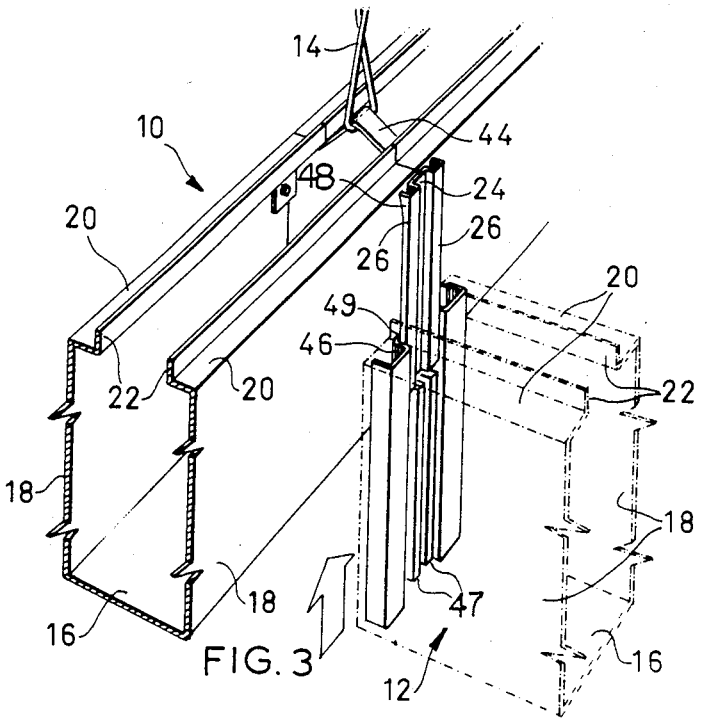
FIG. 3 is an enlarged exploded perspective view showing one system for interconnecting the longitudinal and transverse members of the ceiling structure shown in FIG. 1.
Figure 4:
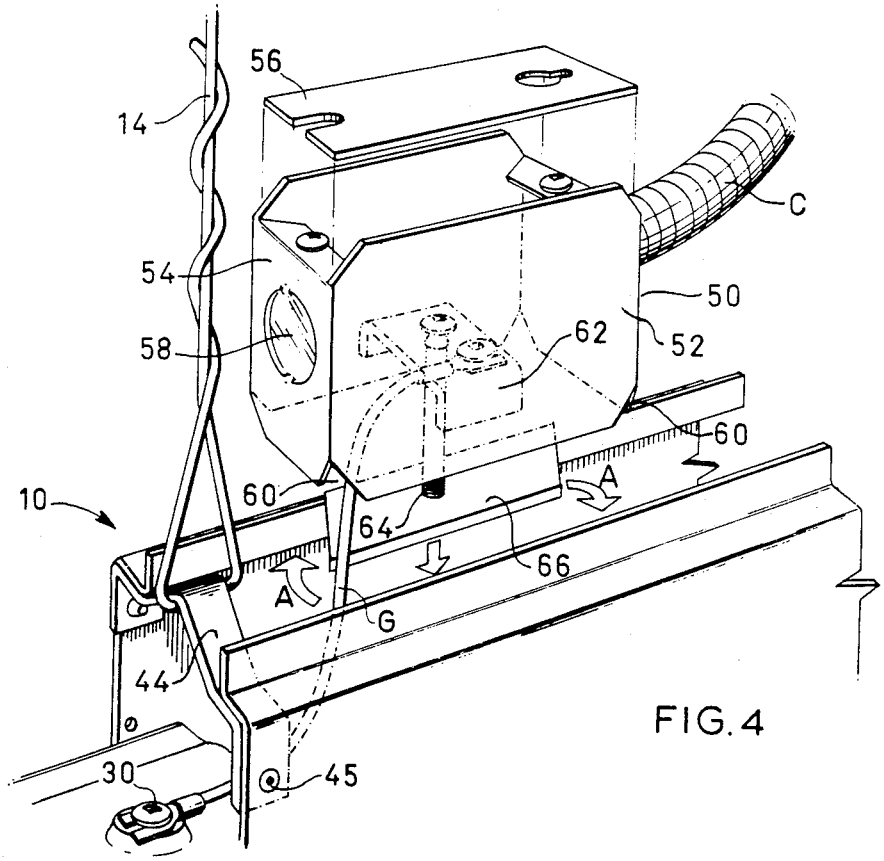
FIG. 4 is an enlarged exploded and fragmentary perspective view showing how an electrical junction box can be mounted on a ceiling structure according to the invention, and, FIG. 5 is an exploded perspective of the connect mechanism shown partially cut away.
Figure 5:
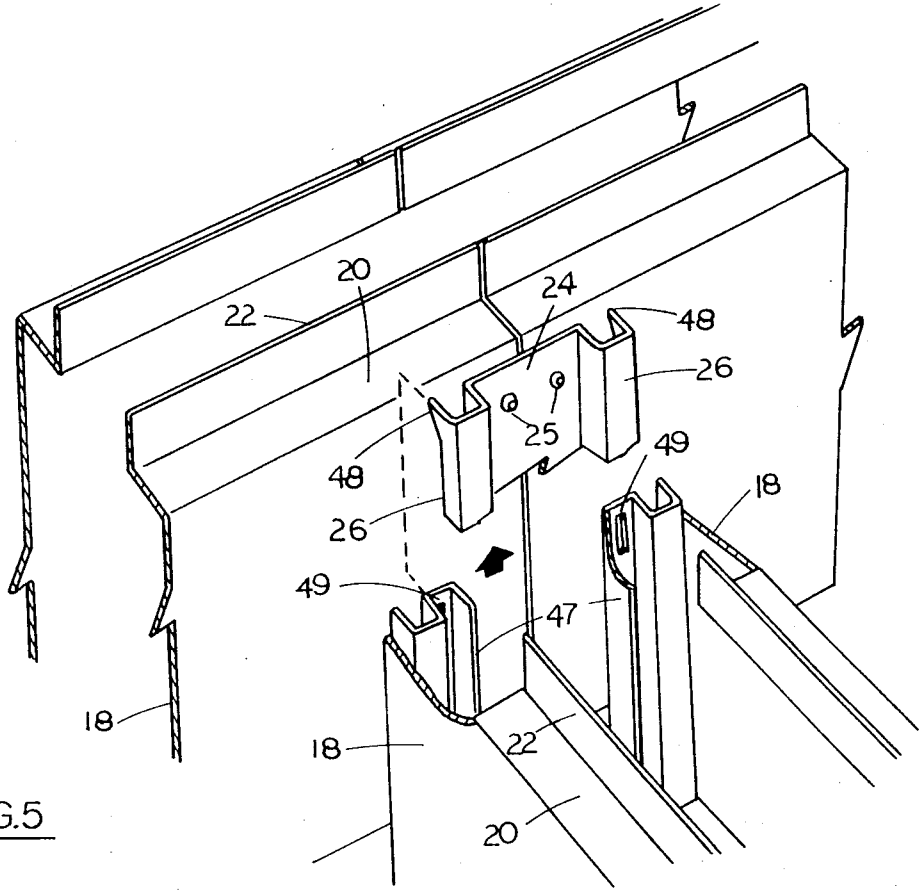

It will be seen from FIG. 3 that the strut 10 shown therein is supported by means of the wire 14 which is attached to a narrow strap 44 extending across the width of the interior of the strut 10 between its side walls 18, and fastened in position by any suitable means such as by the same rivets (not shown) which secure the junction plate 24 in position or by separate rivets 45 as shown in FIG. 4.

One of the transverse struts 12 is shown in more detail in FIG. 3, from which it will be seen that it comprises a bottom wall 16, side walls 18 and top wall portions 20 with lips 22, in the same manner as the longitudinal struts 10.

For joining the ends of transverse struts 12 at right angles to the longitudinal struts 10, end connectors 46 are secured to the interior surfaces of the side walls 18 of the transverse struts 12 by any suitable means, for example, by spot welding or the like. The connectors 46 are formed with connector ribs 47 which are arranged to make a sliding interfitting engagement with the edge flanges 26 on the junction plate 24 and are locked in assembled position by means of locking clips 48 formed on the flanges 26 and interlocking with holes 49 provided in the members 46.

Once assembled in the form of the grid as shown in FIG. 1 and with that grid suspended in position, ceiling panels or acoustic panels P may simply be laid on the top surfaces of the top wall portions 20 of the struts 10 and 12 generally in edge abutment with the flanges 22.

Depending on the size and shape of such ceiling panels P, additional dummy struts (not shown) may be secured between adjacent struts 10 or 12 to support such panels.

Similarly, lighting troffer fixtures F may simply be laid in position longitudinally or transversely with ceiling panels laid on either or both sides thereof in accordance with well known practice. In the same way, air handling fixtures may also simply be laid so that they rest upon the top wall portions 20 of the struts 10 and 12. Usefully, the open spaces between adjacent pairs of the longitudinal and transverse struts 10 and 12 respectively are square in plan so facilitating the positioning of a lighting troffer fixture F in either direction.

Usefully, the electrical power harnesses H are arranged in the longitudinal struts 10 so that they extend from one side to the other of the ceiling thereby providing for a fully flexible system of electrical distribution throughout a given building space.

Electrical power may be supplied to such harnesses H by electrical cables C terminating at connection boxes 50 (FIG. 4).

Such connection boxes 50 will be of any suitable sheet metal construction having side walls 52, end walls 54 and a removable top cover 56. Suitable knock outs 58 may be provided for introduction of the wiring in a conventional manner.

Each connection box 50 has an open base, the lower edges of its side walls 52 being spaced apart a distance such that they will fit snugly around the outer faces of the upstanding flanges 22 of the struts 10.

The end walls 54 of the boxes 50 are dimensioned so that they can extend downwardly between such flanges 22, and so that the aforementioned cover plates 40 will thus abut against the outer faces of the end walls 54 so to provide a completely closed off system.

Notches 60 are formed between the lower portions of the side walls 52 and the end walls 54 so as to permit the former to straddle the upstanding flanges 22 in the manner described.

Within the connection box 50, there is provided a mounting plate 62 which is spot welded or fastened in any other suitable manner to the inner faces of the side walls 52.

A mounting screw 64 extends downwardly from the plate 62 and is threaded into an oversize locking plate 66 which has an elongated rectangular shape, its narrower dimension being such that it will fit between the lips 22, and can then be rotated (arrows A) so as then to underlie the top wall portions 20 of the struts 10. Consequently, when the screw 64 is tightened, it will clamp the connection box 50 to the strut 10. A ground wire G ensures ground continuity between the connection box 50 and the strut 10.

In order to simplify installation of lighting fixtures such as the lighting troffers F, such fixtures will preferably be provided with suitable electrical wiring or cables W provided with conventional two or three pin plugs, which can be plugged into the sockets or receptacles 32 so avoiding the need for time-consuming stripping of cables and connecting of wires.

At the same time, if one such lighting troffer should require servicing, then it is a simple matter for maintenance personnel in the building to simply remove the entire troffer by unplugging it from its receptacle and replacing it with a new one.

As shown in FIG. 1, a ceiling structure according to the invention may, and preferably will be combined with a plurality of vertical posts or columns 70, extending vertically downwardly to the floor below the ceiling. Such posts can be provided therein with electrical cables extending upwardly as at Y to a conventional electrical plug, for example, a three-pin plug, which can be inserted in a convenient one of the receptacles 32. Such a post 70 can then be provided with one or more electrical receptacles at suitable heights for connection of various appliances requiring electrical power.

It will, of course, be understood that some of the services will require different voltages. For example, conventional office equipment requires a supply voltage of 120 V, while other equipment may require a higher voltage. For example, the lighting troffer fixtures F may require a supply voltage from 340 to 350 volts. Accordingly, alternate ones of the struts 10 are preferably wired with harnesses providing different voltages so that one such strut 10 will be a power strut and the next one will be lighting strut and so on. Other combinations of different voltage supplies may also be provided.

The invention also envisages the manufacture of complete strut assemblies in the factory complete with wiring harnesses and receptacles. Plug connection means may be provided at one end of each strut for simplified connection into the main electrical supply system. Receptacles can also be located at regularly spaced intervals along the struts and closed off or covered and sealed, until such time as they are required. The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A ceiling structure which comprises:

a plurality of mutually parallel, mutually spaced apart, hollow, metallic and longitudinal members formed of a plurality of longitudinal segments in end to end relation; a plurality of metallic transverse members having inwardly facing surfaces, and terminally secured to said longitudinal members and extending therebetween to form a grid-like structure including open spaces and having electrical continuity throughout its longitudinal members, and being adapted to receive insulated electrical cables disposed within at least some of said longitudinal members;

junction plates fastened on opposite sides of said longitudinal segments at their ends, joining same together in end to end relation;

attachment flanges on said junction plates;

a pair of connector ribs, fastened on opposite inwardly facing, surfaces of said transverse members at their ends, and dimensioned to fit around respective attachment flanges and interlockable therewith in self-supporting relation;

locking clip means on said attachment flanges;

clip receiving recesses in said connector ribs;

supporting means on said grid-like structure for supporting ceiling panels generally between said longitudinal members and within said open spaces, and, suspension means on said grid-like structure whereby the same may be suspended in position.

2. A ceiling structure as claimed in claim 1 and in which each said longitudinal member has a generally U-shaped sectional configuration and also comprises a removable cover.

3. A ceiling structure as claimed in claim 2 and in which each said cover is removably retained in position on a respective one of said longitudinal members by spring-action fastening means.

4. A ceiling structure as claimed in claim 2 and in which each said longitudinal member comprises a plurality of said removable covers.

5. A ceiling structure as claimed in claim 1 and which additionally comprises ceiling panels supported by said supporting means generally between said longitudinal members and within said open spaces.

6. A ceiling structure as claimed in claim 1 and which additionally comprises at least one electrical receptacle fitting mounted on one of said longitudinal members and connected to said electrical cables.

7. A ceiling structure as claimed in claim 6 and which additionally comprises at least one electrical lighting fixture supported by said supporting means generally between said longitudinal members and within said open spaces.

8. A ceiling structure as claimed in claim 6 and in which said electrical receptacle fitting is removably mounted on one of said longitudinal members.

9. A ceiling structure as claimed in claim 1 and which is supported from an overhead structure by hangers secured to said grid-like structure.

10. A ceiling structure as claimed in claim 1 and in which each said open space has a generally square plan configuration.

11. A ceiling structure as claimed in claim 1 and in which each said longitudinal member comprises a base and two spaced apart side walls, the latter being integrally formed with top wall portions extending toward each other and inwardly terminating in mutually spaced apart upstanding flanges, said top wall portions constituting said supporting means.

12. A ceiling structure adapted for the receipt of electrical wiring therein, said ceiling structure comprising;

a plurality of longitudinal parallel channel members each having a bottom wall and side walls joined to form an integral structure, and flange means along the upper edges of their side walls;

a plurality of transverse channel members extending between said longitudinal members, each said transverse member having a bottom wall, and side walls joined to form an integral structure and flange means along the upper edges of their side walls, lying co-planar with said flange means of said longitudinal members, each transverse member being open at each end, each end being adapted to generally abut against a side wall of a longitudinal member and be held thereagainst by a connection means, said connection means comprising a junction plate means adapted to be attached to said side wall of a longitudinal member, and a connector means adaptable to be attached to a said transverse member at a said open end, said junction plate means and said connector means being interengagable with each other to secure said transverse member to said longitudinal member, said flange means of said side walls of said longitudinal and transverse members thereby providing support means for ceiling fixtures, ceiling panels, and the like, in a predetermined plane located above the plane of said bottom wall and said side walls of said longitudinal and transverse members, and suspension means on at least some of said members, whereby the same may be suspended in position.

13. A ceiling structure as claimed in claim 12 wherein said flange means comprise inwardly directed flange members extending along the upper edge of each side wall, towards one another, and defining a narrow open mouth therebetween for access to the interior of said channel member.

14. A ceiling structure as claimed in claim 13 including upwardly directed lip portions formed along the free edges of said flange members, and forming stops against which said ceiling panels may abut, thereby locating them laterally in position.

15. A ceiling structure as claimed in claim 12 wherein said longitudinal members are each formed in predetermined lengths which are arranged in end abutting relationship, to form said ceiling structure, and said junction plate means are attachable to said side walls only of pairs of said abutting longitudinal channel members, adjacent said abutting ends, for connecting the same together.

16. A ceiling structure as claimed in claim 15 including attachment means on said junction plate means, said junction plate means being of a width adapted to fit within the interior of said transverse members, and be concealed thereby, and said connector means on said transverse members, fastened to the interior only of said side walls of said transverse channel members, and adapted to interengage with said attachment flanges on said junction plate means, whereby the same may be interconnected and supported, with said junction plate means and said connector means concealed from view within the interior of said transverse channel members.

17. A ceiling structure as claimed in claim 16 including electrical wiring in at least some said longitudinal members, and, electrical connection means therefor, whereby the same may be distributed at a variety of points throughout a building.

18. A ceiling structure as claimed in claim 17 including supply pole means extending vertically downwardly from at least some of said channel members, and having electrical wiring in the interior thereof, whereby to permit electrical connection with equipment beneath the ceiling, without disturbing said ceiling panels.

19. In a ceiling structure of the type comprising a plurality of longitudinal hollow channel members having ends, and a plurality of transverse hollow channel members having ends supported between said longitudinal members, and having means providing support for ceiling panels thereon, with at least a major portion of such hollow channel members extending downwardly beneath said support means for such ceiling panels, the combination therewith of connector means releasably interconnecting said longitudinal and transverse members, said connector means comprising;

a plurality of junction plates fastened on either side only of said longitudinal members, adjacent abutting ends thereof, and to be fastened thereto whereby to secure the same together in end to end relationship;

attachment means formed on said junction plates, said junction plates and attachment means being dimensioned and adapted to fit within an adjacent end of a said transverse member, and thereby be concealed from view from below the ceiling, and, engagement means fastened within said ends of said transverse members, and dimensioned to interengage with said attachment means, whereby said transverse members may be connected to said longitudinal members.

20. In a ceiling structure as claimed in claim 19, wherein said attachment means comprise flange means formed on either side of said junction plates, and locking clips formed thereon.

21. In a ceiling structure as claimed in claim 20, wherein said engagement means comprise rib members fastened within said ends of said transverse members, said rib members being formed to interengage with said flange means, and incorporating interlocking means, for interlocking with said locking clips in a releaseable manner, thereby permitting attachment and disengagement of said transverse members from said longitudinal members.

22. A ceiling structure comprising:

a plurality of longitudinal hollow integral one-piece channel members having side walls, and a plurality of transverse hollow integral one-piece channel members supported between said longitudinal members, each transverse member being open at each end, each end being adapted to generally abut against a longitudinal member, a connection means between each end of each said transverse member and said longitudinal member, the connection means comprising a junction plate means adaptable to be attached to a said side wall of a longitudinal member and a connector means adaptable to be attached to a said transverse member at a said open end thereof, said junction plate means and said connector means being interengagable with each other to secure said transverse member to said longitudinal member, said longitudinal and transverse members having means providing support for ceiling panels thereon, with at least a major portion of such hollow channel members extending downwardly beneath said support means for such ceiling panels, and, means for supporting said channel members in a building.

23. A ceiling structure as claimed in claim 22 including ceiling panels supported on said hollow channel members, and there being at least some other ceiling fixtures, mounted on said hollow channel members, and including electrical wiring in said longitudinal channel members, and connecting means connecting said longitudinal wiring with at least some of said other ceiling fixtures, said electrical wiring lying in said longitudinal channel members in a plane located beneath the plane of said ceiling panels, but concealed from view from beneath said ceiling panels.

24. An electrified ceiling structure of the type having a plurality of longitudinal and transverse hollow members, at least some of which contain electrical wiring, and which also support ceiling panels and ceiling fixtures, and having means for supporting such hollow members in a building, said hollow members having spaced apart parallel upstanding flange means along their upper edges defining opening means for access to wiring and further comprising;

an electrical connection box, having side walls, end walls, and a top wall, and said side walls and said end walls having downwardly directed edge portions defining an opening, said side walls and end walls meeting at corners, and said side walls being spaced apart a distance to fit over said upstanding flange means, and enclose the same along a portion of their length, with said opening registering with said opening means between said flange means, and including notch means cut in at least one of said side walls and end walls, and registering with said flange means, whereby said side walls may fit downwardly over said flange means, with said flange means extending upwardly into said notch means.

25. An electrified ceiling structure as claimed in claim 24 wherein said notch means comprise generally triangular shaped notches formed by cutting a portion out of both said side walls and said end walls at their corners.

* * * * *